US007204039B2

(12) United States Patent
Cho et al.

(10) Patent No.: US 7,204,039 B2
(45) Date of Patent: Apr. 17, 2007

(54) WASHING MACHINE HAVING A CONDENSING DUCT

(75) Inventors: Hwang-mook Cho, Suwon-si (KR); Byoung-yull Yang, Ansan-si (KR); Jae-ryong Park, Suwon-si (KR); Hyung-gyoon Kim, Suwon-si (KR); Sang-yeon Pyo, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/197,502

(22) Filed: Aug. 5, 2005

(65) Prior Publication Data

US 2006/0101666 A1 May 18, 2006

(30) Foreign Application Priority Data

Nov. 17, 2004 (KR) ..... 10-2004-0093877

(51) Int. Cl.
*F26B 11/02* (2006.01)

(52) U.S. Cl. ..... 34/596; 68/139

(58) Field of Classification Search ..... 34/595, 34/596, 601–606; 68/139
See application file for complete search history.

(56) References Cited

U.S. PATENT DOCUMENTS 3,132,005 A * 5/1964 McMillan ..... 34/569
4,204,339 A * 5/1980 Muller ..... 34/75
2004/0045327 A1 3/2004 Kim et al.

FOREIGN PATENT DOCUMENTS

| | | | |
|---|---|---|---|
| EP | 0 485 700 | A1 | 5/1992 |
| JP | 11-347282 | A | 12/1999 |
| JP | 2003-79987 | A | 3/2003 |
| JP | 2003-135890 | A | 5/2003 |
| JP | 2005-224351 | A | 8/2005 |
| KR | 2003-0062486 | A | 7/2003 |
| KR | 10-0442400 | B1 | 7/2004 |
| KR | 10-0456953 | B1 | 11/2004 |

* cited by examiner

*Primary Examiner*—S. Gravini
(74) *Attorney, Agent, or Firm*—Sughrue Mion, PLLC

(57) ABSTRACT

A washing machine includes a drum and a condensing duct connected with the drum. The condensing duct includes an air inlet, an air outlet and a condensing unit. A condensation water spray member is disposed in the condensing duct and a condensation water dispersing plate is supported by a lower portion of an inside wall in the condensing unit, and formed with an air-passing hole connected with the air inlet in a center portion thereof.

4 Claims, 6 Drawing Sheets

WASHING MACHINE HAVING A CONDENSING DUCT

CROSS-REFERENCE TO RELATED APPLICATIONS

This application claims the benefit of Korean Patent Application No. 2004-0093877, filed on Nov. 17, 2004, in the Korean Intellectual Property Office, the disclosure of which is incorporated herein by reference.

BACKGROUND OF THE INVENTION

1. Field of the Invention

The present invention relates to a washing machine, and more particularly, to a washing machine having an improved condensation structure.

2. Description of the Related Art

Generally, a washing machine washes clothes by using mechanical power and is classified into many types according to a washing method. Especially, a drum type washing machine is an appliance intended to carry out a washing operation by tumbling clothes using a little water, and it also carries out rinsing, dehydrating and drying operations.

During the drying operation of the drum washing machine, air heated by a heater is supplied to a drum to heat the clothes and hot moisture-laden air subtracted from the heated clothes is condensed to enhance drying efficiency.

A conventional drum washing machine comprises a drum; a condensing duct connected with the drum; a condensation water spray member disposed in the condensing duct; an ascent limitation projection which limits the ascent of condensation water that flows backward in the upper portion of the inside of the condensing duct; and a condensation water stay projection which allows the condensation water falling down from the ascent limitation projection to be dispersed. The drum washing machine having such a configuration is disclosed in Korean Patent Application No. 10-2002-0054390.

However, for the drum washing machine having such a structure, not only is the condensation water stay projection disposed in partly one first side of the condensing duct, but also disperses limited condensation water flowing down from the ascent limitation projection, thereby having relatively less dispersing effect of the condensation water. Thus, the conventional drum washing machine has a limitation to enhance condensing efficiency of the air passing through the condensing duct.

SUMMARY OF THE INVENTION

Illustrative, non-limiting embodiments of the present invention overcome the above disadvantages, as well as other disadvantages not mentioned above.

Accordingly, an apparatus consistent with the present invention provides a washing machine capable of enhancing dispersion of condensation water sprayed into a condensing duct.

Additional aspects and/or advantages of the present invention will be set forth in part in the description which follows and, in part, will be obvious from the description, or may be learned by practice of the present invention.

The foregoing and/or other aspects of the present invention are also achieved by providing a washing machine comprising a drum; a condensing duct connected with the drum, and comprising an air inlet, an air outlet and a condensing unit; a condensation water spray member disposed in the condensing duct; and a condensation water dispersing plate supported by a lower portion of an air-passing hole connected with the air inlet in a center portion thereof.

According to an aspect of the present invention, the air-passing hole is larger than the air inlet.

According to an aspect of the present invention, the condensation water dispersing plate is perpendicular to a flowing direction of internal cycling air passing through the condensing duct.

The foregoing and/or other aspect of the present invention are also achieved by providing a drying machine comprising a drum; a condensing duct connected with the drum, and comprising air inlet, an air outlet and a condensing unit; a condensation water spray member disposed in the condensing duct; and a condensation water dispersing plate is supported by a lower portion of an inside wall in the condensing unit, and formed with an air-passing hole connected with the air inlet in a center portion thereof.

BRIEF DESCRIPTION OF THE DRAWINGS

The above and/or other features and advantages of the present invention will become apparent and more readily appreciated from the following description of the exemplary embodiments, taken in conjunction with the accompanying drawings of which.

DETAILED DESCRIPTION OF THE PREFERRED EMBODIMENT

Figure 1:
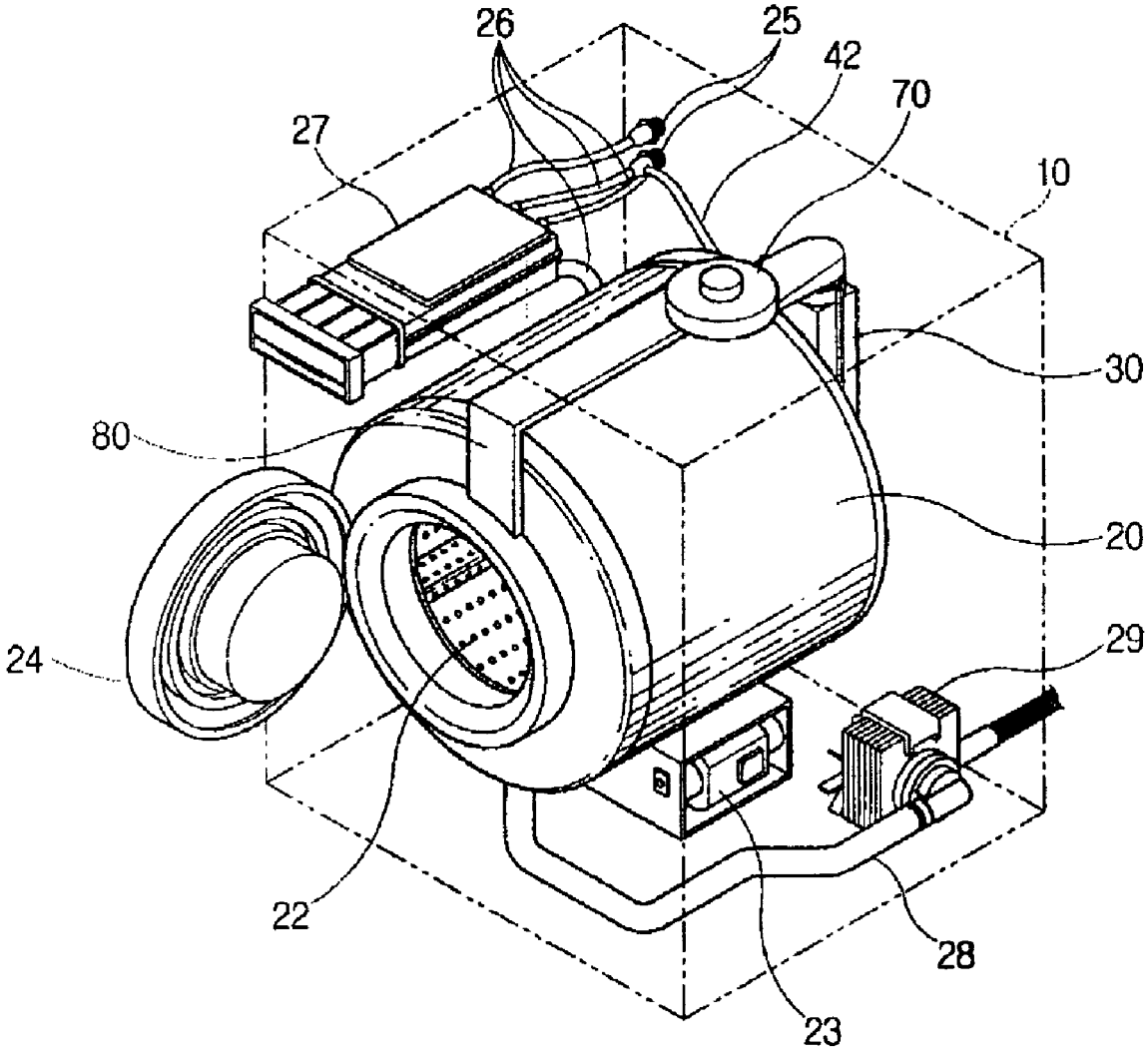
FIG. 1 is a perspective view of a drum washing machine according to the present invention.

Reference will now be made in detail to the embodiments of the present invention, examples of which are illustrated in the accompanying drawings, wherein like reference numerals refer to like elements throughout.

Figure 2:
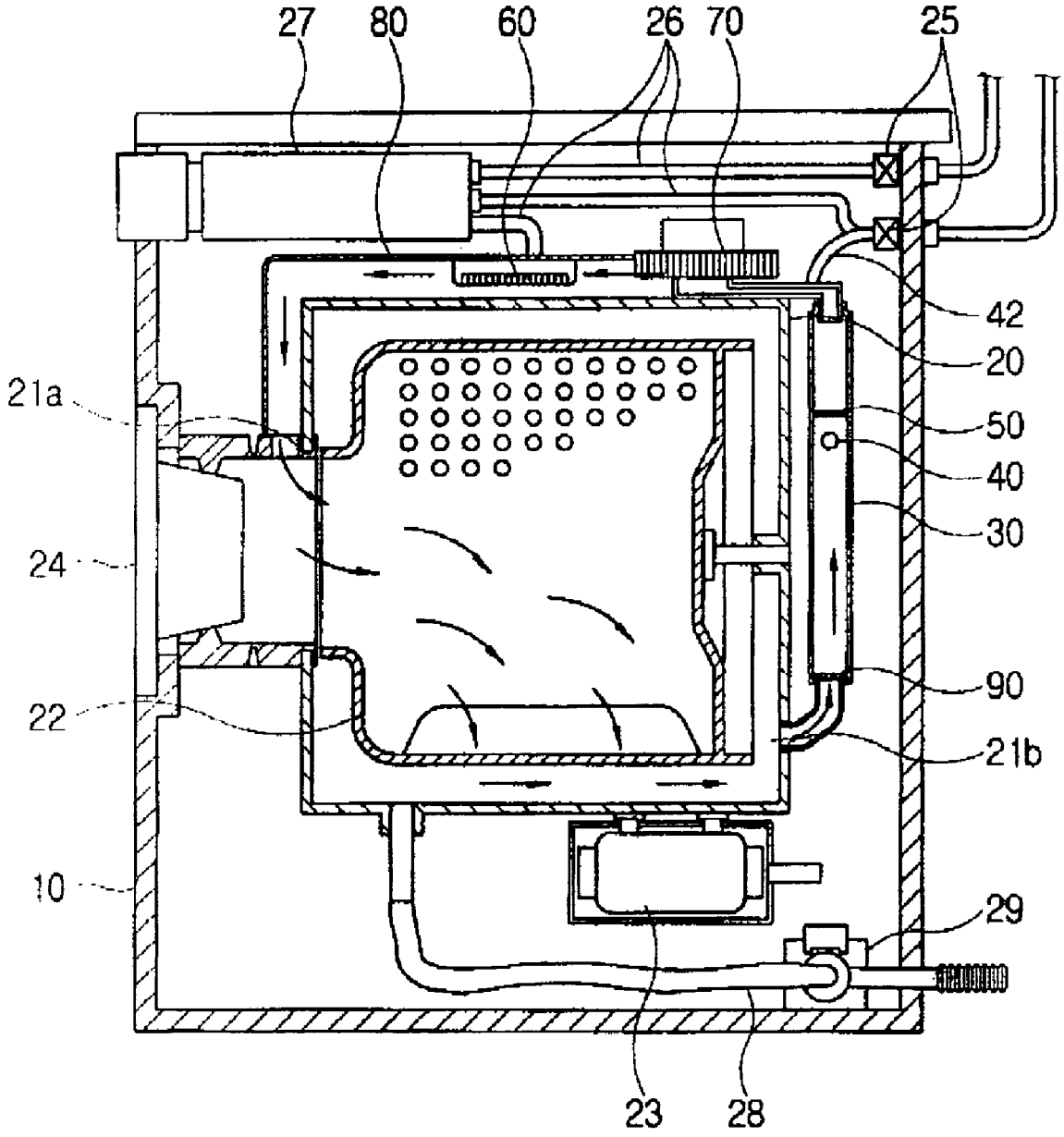
FIG. 2 is a sectional view of the drum washing machine according to the present invention.

As shown in FIG. 1 and 2, a drum washing machine according to the present invention comprises a main body 10; a cylindrical drum 20 provided in the main body 10, for containing clothes therein; a cylindrical washing chamber 22 rotatably provided in the drum 20, and forming a dewatering hole on a wall thereof; a driving motor 23 provided in a lower portion of the drum 20, and rotating the washing chamber 22 clockwise or counterclockwise to operate washing, rinsing and dewatering phases; a door 24 provided to be opened and closed in a front portion of the main body 10.

In an upper portion of the drum 20 is provided a water supply unit comprising a supply valve 25, a water supply pipe 26, a laundry detergent unit 27 and the like to fill the drum with water, and at the same time, to dissolve a laundry detergent as well.

Further, in the upper portion of the drum 20 is provided a drying unit to dry the clothes after the dewatering phase is completed.

The drying unit comprises a fan 70 disposed in the upper part of the drum 20; a discharge duct 80 provided to be connected with the fan 70 and an air inlet 21*a* of the drum therebetween; a heater 60 is provided inside the discharge duct 80; a condensing duct 30 communicating with an air outlet 21*b* of the drum 20 and the fan 70 therebetween; a condensation water spray member 40 provided in the condensing duct 30, and spraying condensation water; and a condensation water supply pipe 42 is connected to the condensation water spray member 40 and supplying the condensation water thereto. With this configuration, air supplied by the fan 70 passes through the discharging duct 80 and is heated by the heater 60. The heated air is supplied to inside of the drum 20 through the air inlet 21*a* to heat and dry the clothes.

During the drying phase, hot moisture-laden air is generated and introduced into the condensing duct 30 through the air outlet 21*b* of the drum 20, moisture contained in the hot moisture-laden air is condensed by the condensation water sprayed from upper portion to lower portion of the condensing duct 30 by the condensation water spray member 40, when the hot moisture-laden air passes through the condensing duct 30 and flows into the fan 70.

In the lower portion of the drum 20 is provided a drain unit comprising a drain pipe 28, a drain pump 29 and the like to drain washing water.

In the condensing duct 30 is provided a condensation water back flowing guide 50 to prevent the condensation water which is dispersed by internal cycling air passing through the condensing duct 30 from flowing back to inside of the drum 20. A back flowing of the condensation water happens due to dispersion of the condensation water caused by increasing velocity of the internal cycling air to enhance the efficiency of drying.

In a lower portion of the condensing duct 30 is provided a condensation water dispersing plate 90 to increase dispersion of the condensation water which is sprayed from the condensation water spray member 40.

Figure 3:
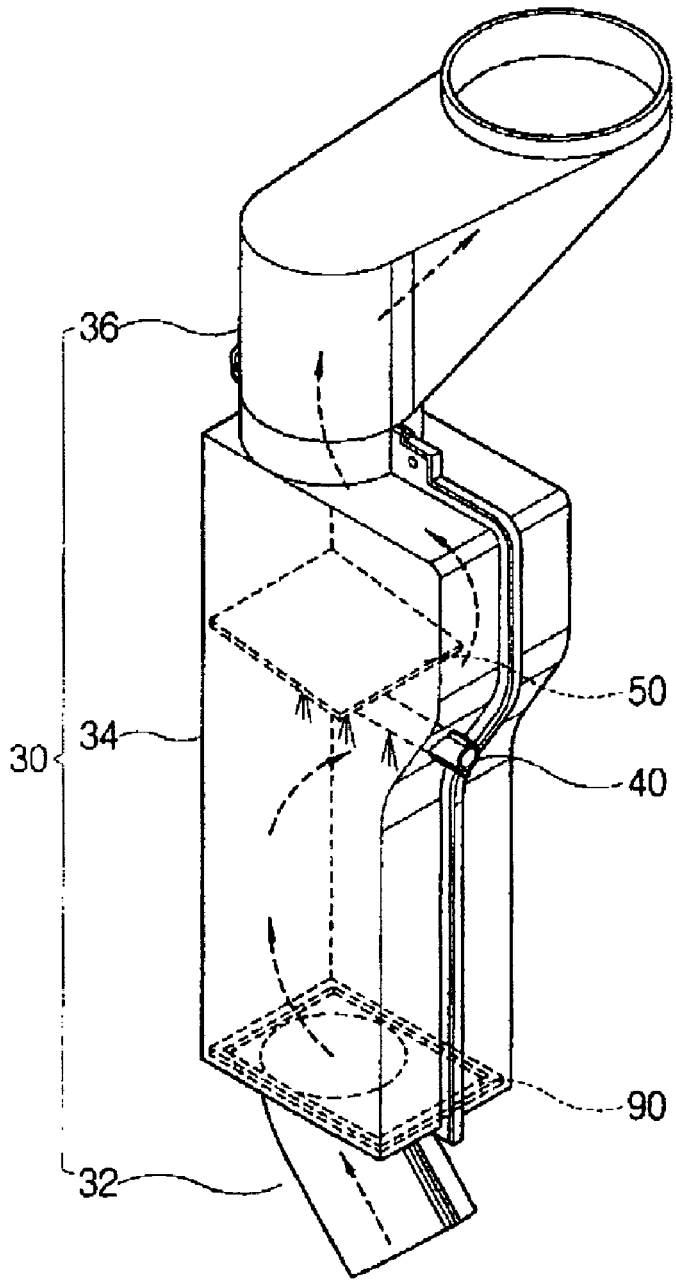
FIG. 3 is a perspective view showing a condensing duct of the drum washing machine according to a first embodiment of the present invention.
Figure 4:
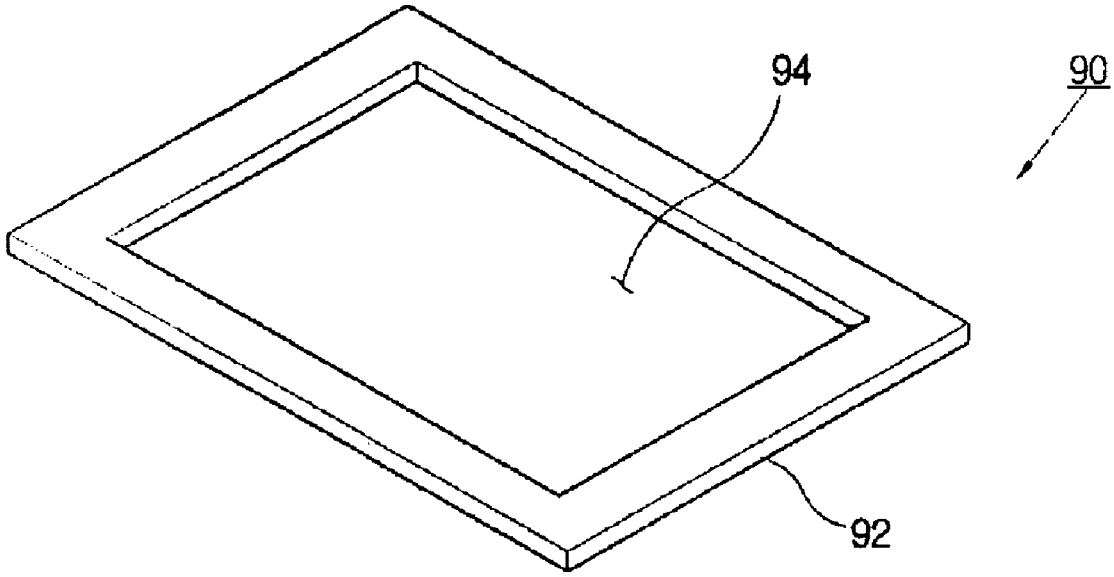
FIG. 4 is a perspective view showing a condensation water dispersing plate disposed in the condensing duct of the drum washing machine according to the first embodiment of the present invention.
Figure 5:
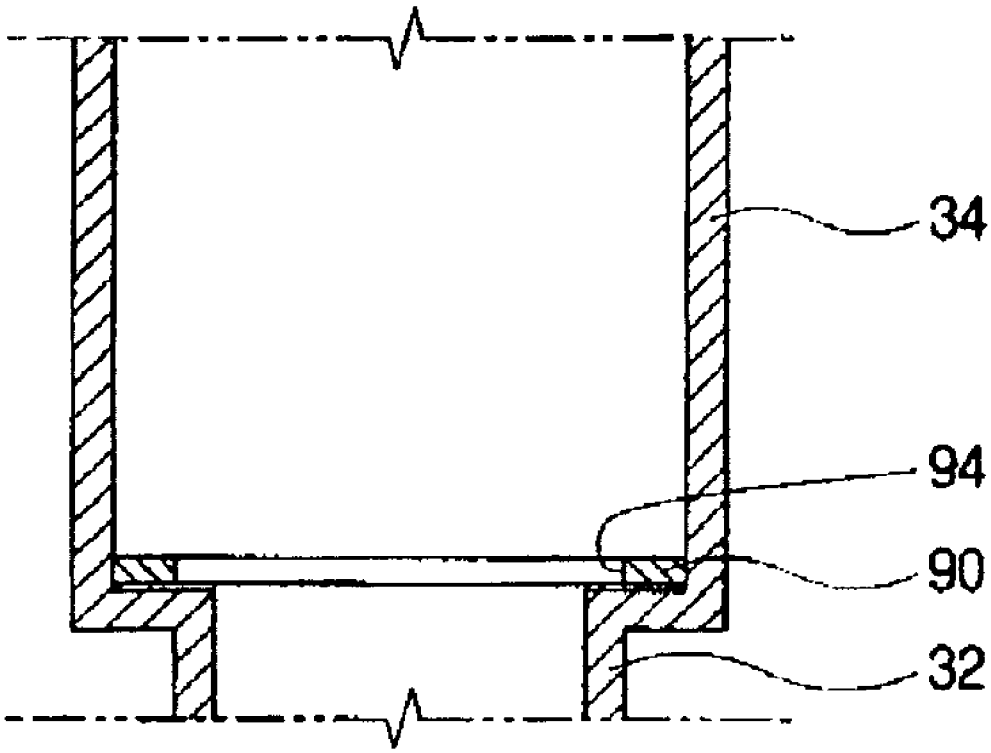
FIG. 5 is a partial sectional view showing an installation state of the condensation water dispersing plate in the condensing duct of the drum washing machine according to the first embodiment of the present invention.

As shown in FIGS. 3 to 5, the condensing duct 30 according to the present invention comprises an air inlet 32 to which internal air of the drum 20 is introduced; a condensing unit 34 through which the air introduced by the air inlet 32 passes; and an air outlet 36 discharging the air which passes through the condensing unit 34.

The condensation water dispersing plate 90 is disposed on an inner wall of a lower portion in the condensing unit 34. Also, an external surface 92 of the condensation water dispersing plate 90 is disposed to maintain airtightness with the inner wall of the condensing unit 34 to keep the condensation water sprayed from the condensation water spray member 40 on an upper surface of the condensation water dispersing plate 90.

In a center portion of the condensation water dispersing plate 90 is provided an air passing hole 94 which is connected with the air inlet 32 of the condensing duct 30. The internal cycling air introduced from the air inlet 32 disperses the condensation water kept in the condensation water dispersing plate 90 while passing through the air passing hole 94. The condensation water back flowing guide 50 limits ascent of the condensation water dispersed to prevent from flowing back to the air outlet 36.

When the width of the air inlet 32 is smaller than that of the condensing unit 34, a flow speed of the internal cycling air is relatively fast. Thus, the efficiency of dispersing the condensation water is further increased. An external appearance of the condensation water dispersing plate 90 is variable according to the applied condensing duct 30, and a shape of the air passing hole 94 may also be varied as long as it enhances dispersing efficiency.

A size of the air passing hole 94 in the condensation water dispersing plate 90 is larger than the air inlet 32 of the condensing duct 30. Also, the condensation water dispersing plate 90 is preferably perpendicular to a flowing direction of the inner cycling air.

Figure 6:
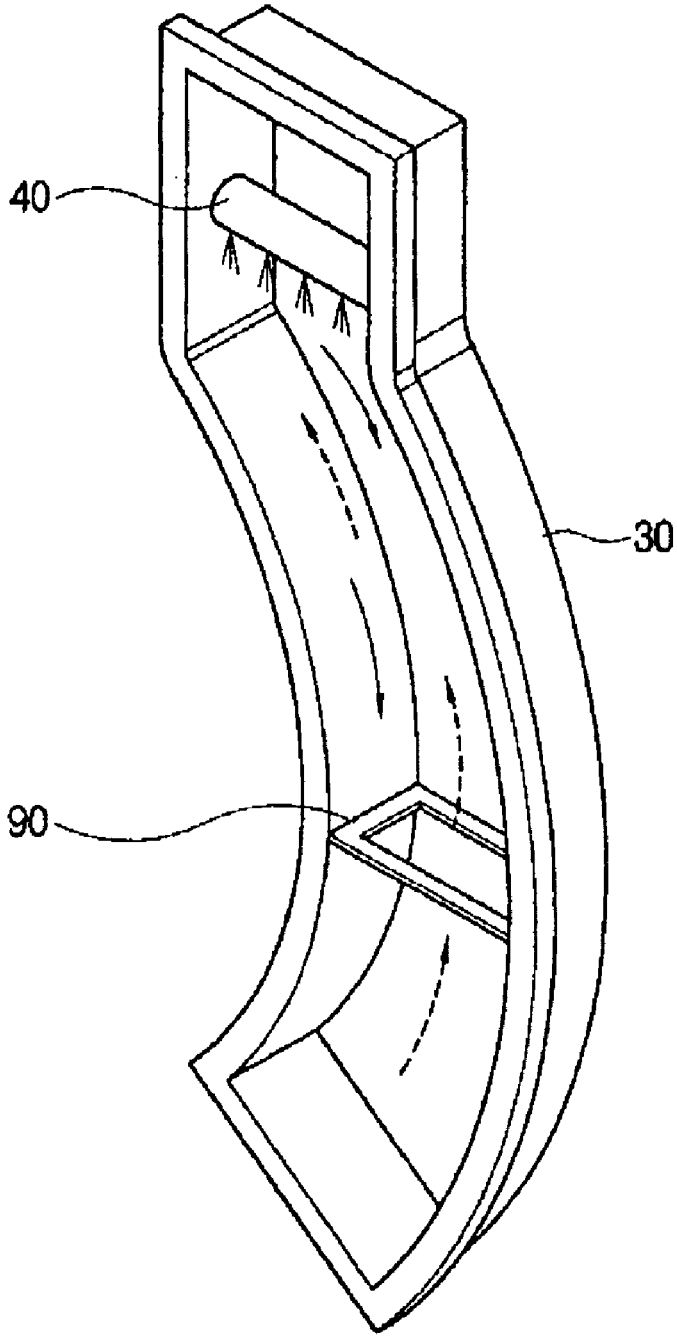
FIG. 6 is a perspective view showing the condensing duct of the drum washing machine according to a second embodiment of the present invention.

The condensation water dispersing plate 90 may be disposed in the condensing duct 30 having a structure as shown in FIG. 6 and disperses the condensation water sprayed from the condensation water spray member 40, thereby enhancing the condensing efficiency. The structure of the condensing duct 30 may be varied.

The present invention includes embodiments of a drum washing machine having a drying unit, the present invention may also be applicable by those of ordinary skill in the art to a dryer or other similar machine to dry clothes. In this case, a drum in the drum washing machine performs the same function as the drum containing clothes of the drying machine, and other elements are applied similarly.

Although a few exemplary embodiments of the present invention have been shown and described, it will be appreciated by those of ordinary skill in the art that changes may be made in these embodiments without departing from the principles and spirit of the invention, the scope of which is defined in the appended claims and their equivalents.

What is claimed is:

1. A washing machine comprising:

a drum;

a condensing duct connected with the drum, and comprising an air inlet, an air outlet and a condensing unit;

a condensation water spray member disposed in the condensing duct; and a condensation water dispersing plate supported by a lower portion of an inside wall in the condensing unit, and formed with an air-passing hole connected with the air inlet in a center portion thereof, wherein the condensation water dispersing plate is disposed in the condensing unit between the air inlet and the condensation water spray member.

2. The washing machine according to claim 1, wherein the air-passing hole is larger than the air inlet.

3. The washing machine according to claim 2, wherein the condensation water dispersing plate is perpendicular to a flowing direction of internal cycling air passing through the condensing duct.

4. A drying machine comprising:

a drum;

a condensing duct connected with the drum, and comprising an air inlet, an air outlet and a condensing unit;

a condensation water spray member disposed in the condensing duct; and a condensation water dispersing plate supported by a lower portion of an inside wall in the condensing unit, and formed with an air-passing hole connected with the air inlet in a center portion thereof, wherein the condensation water dispersing plate is disposed in the condensing unit between the air inlet and the condensation water spray member.

* * * * *